US011794860B1

(12) United States Patent
Fitzgerald et al.

(10) Patent No.: US 11,794,860 B1
(45) Date of Patent: Oct. 24, 2023

(54) WATERCRAFT DRINKING VESSEL HOLDER AND METHOD FOR RETAINING A DRINKING VESSEL ON A WATERCRAFT

(71) Applicant: Floatsup, LLC, Whitefish, MT (US)

(72) Inventors: Eric Kendall Fitzgerald, Rogue River, OR (US); Paige Emma Nilsen, Rogue River, OR (US)

(73) Assignee: FLOATSUP, LLC, Whitefish, MT (US)

( * ) Notice: Subject to any disclaimer, the term of this patent is extended or adjusted under 35 U.S.C. 154(b) by 226 days.

(21) Appl. No.: 17/475,640

(22) Filed: Sep. 15, 2021

Related U.S. Application Data

(60) Provisional application No. 63/212,220, filed on Jun. 18, 2021.

(51) Int. Cl.
*B63B 32/77* (2020.01)
*B63B 32/70* (2020.01)

(52) U.S. Cl.
CPC ..... *B63B 32/77* (2020.02); *B63B 32/70* (2020.02)

(58) Field of Classification Search
CPC ..... B63B 32/77; B63B 32/70
See application file for complete search history.

(56) References Cited

U.S. PATENT DOCUMENTS

| | | | | |
|---|---|---|---|---|
| 3,491,976 | A * | 1/1970 | Larson | A47B 13/16 215/393 |
| 4,681,219 | A | 6/1987 | Kitchens | |
| 5,217,271 | A | 6/1993 | Moe | |
| 6,050,213 | A * | 4/2000 | Stevens | B63B 17/00 114/364 |
| 6,364,151 | B1 * | 4/2002 | Gale | A47G 23/0216 220/737 |
| 6,755,145 | B2 | 6/2004 | Bolebruch | |
| 9,021,973 | B2 | 5/2015 | Smith | |
| 9,801,483 | B2 * | 10/2017 | D'Alesio | F16B 47/00 |
| 2014/0004762 | A1 | 1/2014 | Smith | |

* cited by examiner

*Primary Examiner* — Stephen P Avila
(74) *Attorney, Agent, or Firm* — Jerry Haynes Law

(57) ABSTRACT

A watercraft drinking vessel holder and method for retaining a drinking vessel on a watercraft is configured to contain a can, cup, or water bottle for easy access during paddle boarding. The vessel holder attaches to a flat watercraft through multiple crisscrossing stretch cords that pass through elongated slots forming through the longitudinal of the vessel holder. The crisscrossing stretches cords retain the vessel holder substantially upright on the watercraft. The vessel holder has a flat base designed to sit flush against the surface of watercraft. A sidewall projects upwardly from the base. The sidewall receives drinking vessel, and substantially encapsulates drinking vessel. The sidewall defines multiple slots extending along the longitudinal in a spaced-apart, parallel relationship. The slots enable passage of elastic cords that crisscross therethrough. The cords are pulled down towards the base end of the sidewalls to firmly secure the vessel holder to the watercraft.

20 Claims, 5 Drawing Sheets

WATERCRAFT DRINKING VESSEL HOLDER AND METHOD FOR RETAINING A DRINKING VESSEL ON A WATERCRAFT

CROSS-REFERENCE TO RELATED APPLICATIONS

This application claims the benefit of U.S. provisional application No. 63/212,220, filed Jun. 18, 2021, and entitled "WATERCRAFT DRINKING VESSEL HOLDER AND METHOD FOR RETAINING A DRINKING VESSEL ON A WATERCRAFT", which provisional application is hereby incorporated by reference herein in its entirety.

FIELD OF THE INVENTION

The present invention relates generally to a watercraft drinking vessel holder and method for retaining a drinking vessel on a watercraft. More so, the present invention relates to a watercraft drinking vessel holder configured to contain a can, cup, water bottle or other beverage container for easy access during paddle boarding or other water activities; and that attaches to a flat watercraft, such as a paddle board, through use of multiple crisscrossing or intersecting stretch cords that pass through elongated slots extending along the longitudinal axis of the vessel holder.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, summary, or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting unless the claims expressly state otherwise.

Figure 1:
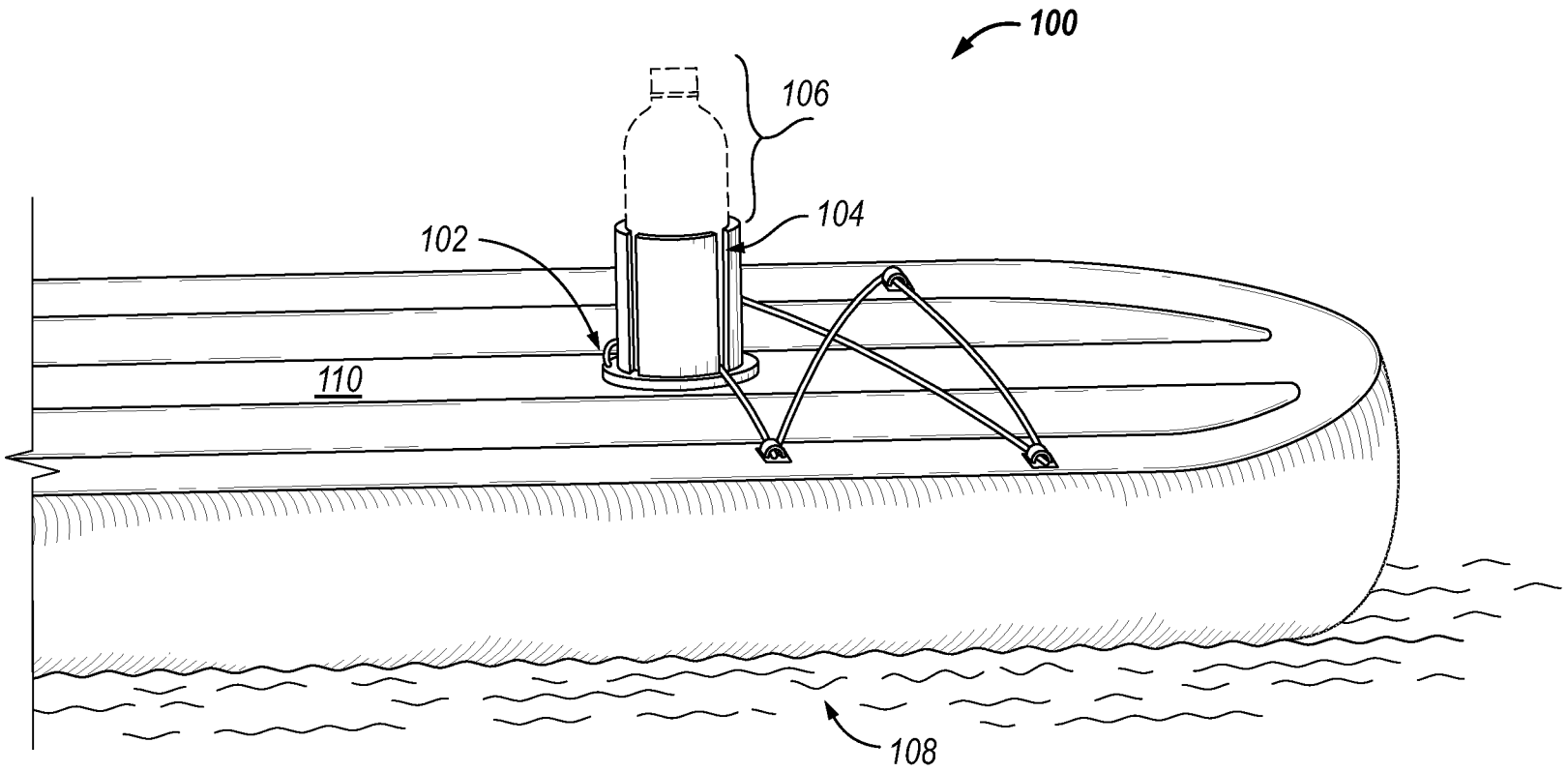
FIG. 1 illustrates a perspective view of an exemplary watercraft drinking vessel holder tethered to a watercraft by at least one cord, in accordance with an embodiment of the present invention.
Figure 2:
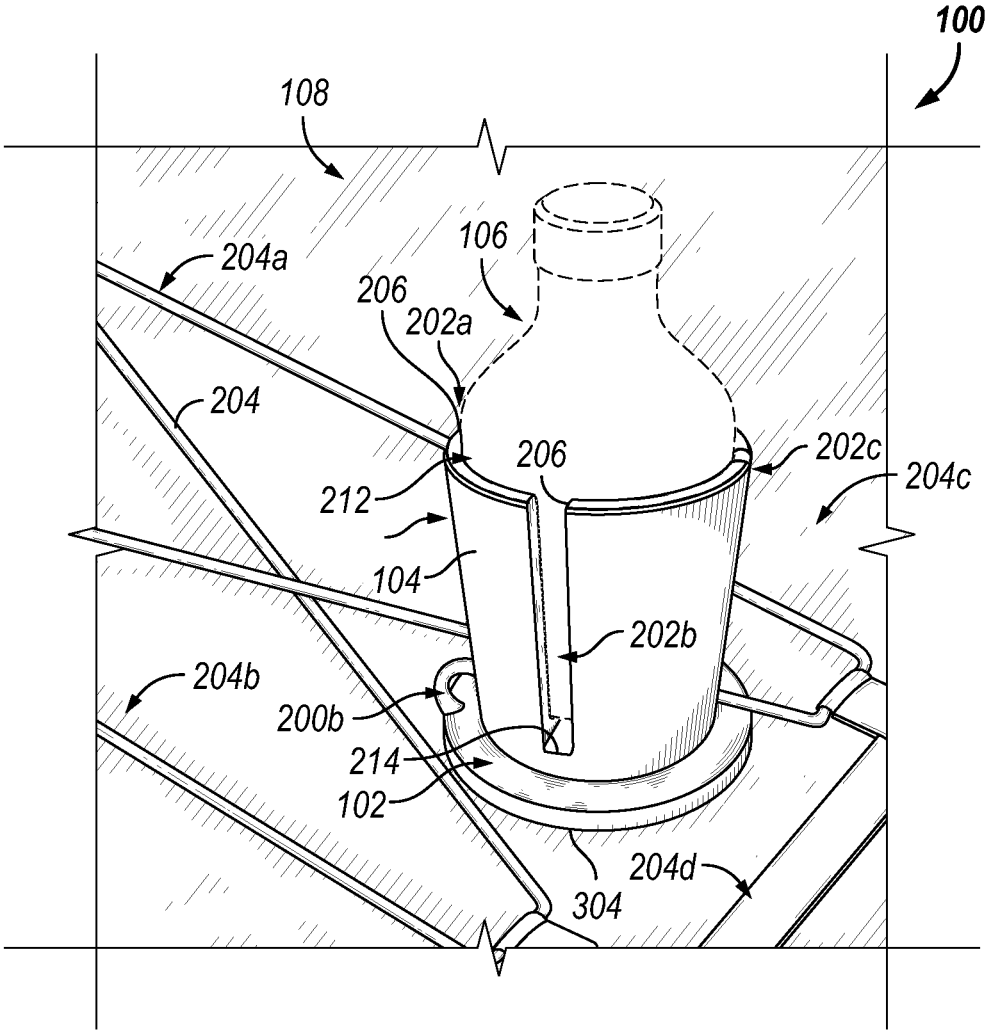
FIG. 2 illustrates a close-up perspective view of the watercraft drinking vessel holder tethered to a watercraft and retaining a drinking vessel, in accordance with an embodiment of the present invention.

A watercraft drinking vessel holder 100 and method for retaining a drinking vessel 106 on a watercraft is referenced in FIGS. 1-6. The watercraft drinking vessel holder 100, hereafter "vessel holder 100", is configured to contain a can, cup, water bottle or other beverage container or drinking vessel 106 for easy access during paddle boarding or other water activities. As illustrated in FIGS. 1 and 2, the vessel holder 100 may be configured for attachment to a deck or other flat surface 110 on a watercraft 108, such as a paddleboard, for example and without limitation, through use of multiple cord strands 204*a-d* of one or more holder cords 204 (FIG. 2). The cord strands 204*a-d* may extend in a crisscrossing or intersecting pattern through elongated sidewall slots 202*a-d* which extend longitudinally through a holder sidewall 104 of the vessel holder 100 and seat in at least one linear depression 400*a, b* in a holder base 102 of the vessel holder 100. In some embodiments, a plurality of linear depressions 400*a, b* may intersect at a cord intersection 210 (FIG. 6) in the holder base 102. Thus, the cord strands 204*a-d* of the holder cord 204 retain the vessel holder 100 in a substantially upright position on the flat surface 110 of the watercraft 108 as the vessel holder 100 receives and retains the drinking vessel 106 in a substantially upright position.

In some embodiments, the vessel holder 100 has a flat holder base 102 designed to sit flush against the flat surface 110 of the watercraft 108. The holder base 102 provides lateral stability to the vessel holder 100 and the drinking vessel 106 contained therein. A holder sidewall 104 projects upwardly from the holder base 102. In some embodiments, the holder sidewall 104 may be cylindrical, as illustrated. In other embodiments, the holder sidewall may have an oval, square, rectangular, elliptical, or polygonal cross-section.

Figure 3:
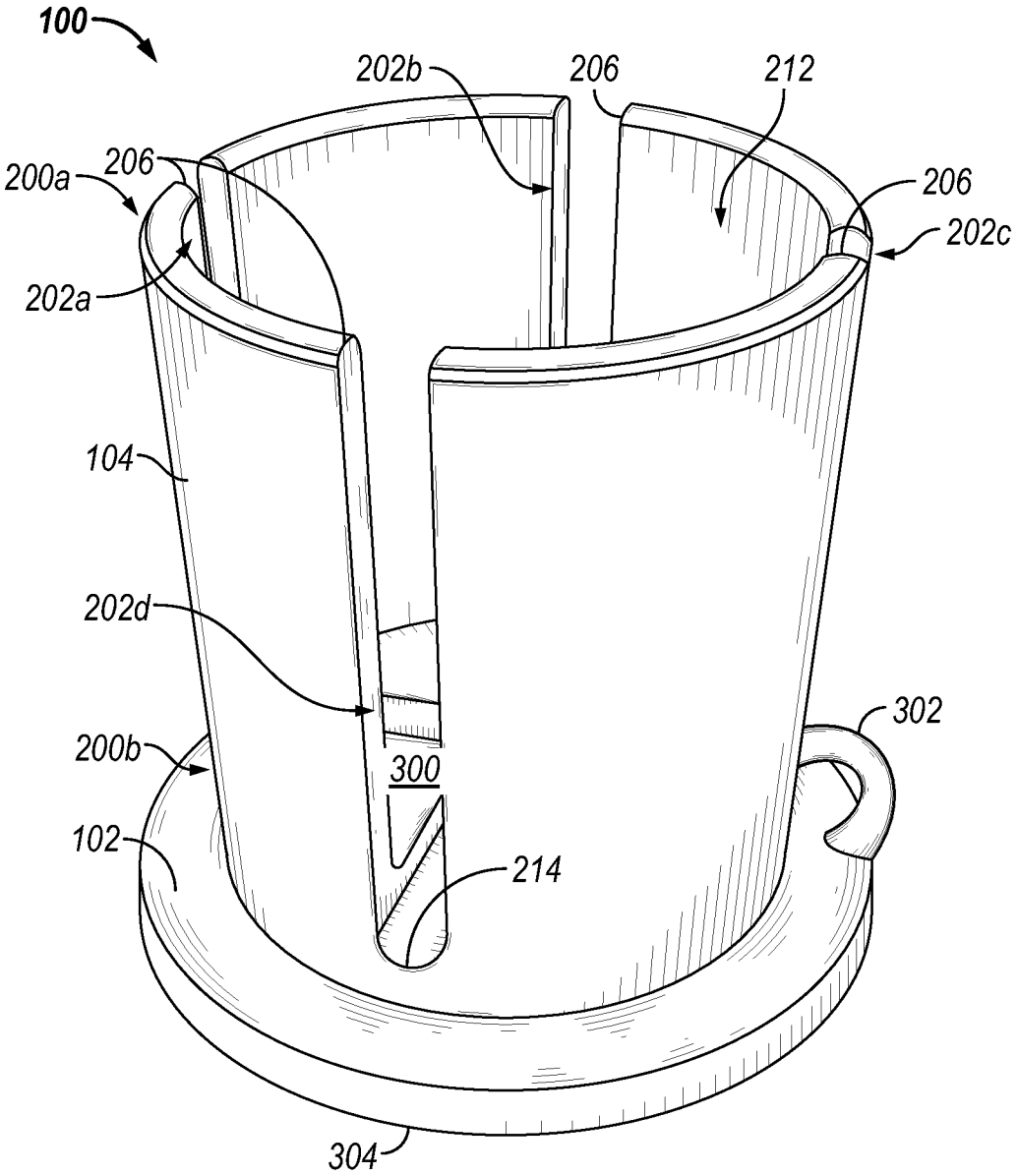
FIG. 3 illustrates an upper perspective view of the watercraft drinking vessel holder, showing the slots extending to the base, in accordance with an embodiment of the present invention.

As illustrated in FIG. 3, the holder sidewall 104 has a sidewall base end 200*b* at the holder base 102 and a sidewall free end 200*a* opposite the sidewall base end 200*b*. The holder base 102 and the holder sidewall 104 define a holder interior 212. The holder interior 212 is suitably sized and configured to receive the drinking vessel 106. In some embodiments, the holder interior 212 may be suitably sized and configured such that the holder sidewall 104 substantially engages and surrounds or encapsulates the drinking vessel 106.

The holder base 102 has a flat or planar base top face 300 and a base bottom face 304. The base bottom face 304 may be operable to rest flush or flat against the flat surface 110 on the watercraft 108. As particularly illustrated in FIGS. 4 and 5, at least one, and typically, a plurality of intersecting linear depressions 400*a*, 400*b* extend or recess into the base top face 300 of the holder base 102. Each linear depression 400*a*, 400*b* is sized and dimensioned to receive at least one, and typically, the crisscrossing or intersecting cord strands 204*a*, 204*b* (FIG. 6) of the holder cord 204 in securement of the vessel holder 100 on the flat surface 110 of the watercraft 108.

Multiple sidewall slots 202*a-d* extend through the holder sidewall 104 in spaced-apart, parallel relationship to each other. The sidewall slots 202*a-d* correspond in position to and register and communicate with the respective linear depressions 400*a*, 400*b* in the base top face 300 of the holder base 102. The sidewall slots 202*a-d* may extend from the sidewall free end 200*a* to the sidewall base end 200*b* of the holder sidewall 104. As illustrated in FIG. 3, each sidewall slot 202*a-d* may have an open slot end 206 at the sidewall free end 200*a* of the holder sidewall 104. A closed slot end 214 of each sidewall slot 202*a-d* may terminate near but not extend fully to the base 102 at the sidewall base end 200*b*. The closed slot end 214 of each sidewall slot 202*a-d* may align or register and communicate with a corresponding one of the linear depressions 400*a*, 400*b* in the holder base 102.

The sidewall slots 202*a-d* are sized and dimensioned to enable passage of the typically crisscrossing or intersecting cord strands 204*a*, 204*b* (FIG. 6) of the holder cord 204 as the cord strands 204*a-b* are deployed in the linear depressions 400*a*, 400*b* in the holder base 102. The cord strands 204*a-d* are initially pulled down through the sidewall slots 202*a-d* towards the base end 200*b* of the sidewall 104 and then into the respective linear depressions 204*a*, 204*b* to firmly secure the vessel holder 100 to the flat surface 110 on the watercraft 108.

In one aspect, shown in FIGS. 1-6, the vessel holder 100 comprises:

a holder base 102 having a base top face 300 and a base bottom face 304, the base bottom face 304 operable to rest flush against a flat surface 110 on a watercraft 108; and a holder sidewall 104 projecting up from the base top face 300 of the holder base 102, the holder sidewall 104 defining a sidewall base end 200*b* and a sidewall free end 200*a*, the sidewall base end 200*b* joined with the base top face 300 of the holder base 102, the holder sidewall 104 further defining multiple spaced-apart, parallel sidewall slots 202*a-d* extending from the sidewall free end 200*a* to approximately the terminus of the sidewall base end 200*b*, the sidewall slots 202*a-d* being sized and dimensioned to receive at least one cord strand 204*a-d* of at least one holder cord 204, whereby the cord strands 204*a-d* of the holder cord 204 crisscross or intersect each other through the sidewall slots 202*a-d* for securing the vessel holder 100 to the watercraft 108.

In another aspect, the base top face 300 of the holder base 102 forms multiple linear depressions 400*a*, 400*b* aligned and communicating with the sidewall slots 202*a-d*.

In another aspect, the holder base 102 has a circular shape.

In another aspect, the holder sidewall 104 has a cylindrical shape.

In another aspect, the at least one holder cord 204 comprises an elastic cord.

In another aspect, the vessel holder 100 is fabricated from rubber-like such as silicone.

In another aspect, the vessel holder 100 further comprises a tethering ring 302 joined to the holder or holder base 102.

One objective of the present invention is to contain a can, cup, water bottle or other drinking vessel 106 for easy access during paddleboarding or other water activities.

Another objective is to allow for flexibility on placement of a drinking vessel 106 in case there is a cooler or other items on or under the holder cord 204.

Another objective is to restrict beverages from falling over on a paddleboard, and easily share drinks with friends during a paddle.

Yet another objective is to enable easy portability of the vessel holder 100 between multiple paddleboards.

Yet another objective is to provide a method of attaching the vessel holder 100 to a watercraft 108 that has anchored thereto cords, such as bungee cords.

Yet another objective is to provide an inexpensive to manufacture watercraft drinking vessel holder 100.

Those skilled in the art will recognize that a paddleboard has a substantially flat surface that makes retaining drinking vessels in an upright position difficult during operation of the watercraft. Prior art cup holders often leave residue on a board, or they have a suction cup that only works on smooth surfaces and does not work on the padded portion of the board. Thus, if it is necessary to suction the cup holder to a smooth surface, the cup holder is too far away to easily access while on the board. The present disclosure utilizes the unique sidewall slots 202*a-d* that allow for flexibility for placement of the drinking vessel 106, even when there is a cooler or other items on or under the holder cord 204.

As FIG. 1 references, the vessel holder 100 comprises a holder base 102 that serves as the supportive foundation for the vessel holder 100. As illustrated in FIGS. 3-6, the holder base 102 has a base top face 300 oriented upwardly and a base bottom face 304 oriented towards the watercraft 108. The base bottom face 304 is designed to rest flush against the flat surface 110 of a watercraft 108. The watercraft 108 may include, without limitation, a paddleboard, a propeller boat, a kayak, a canoe, a motorboat, or a flat boat. The holder base 102 may have a circular, triangular, rectangular, elliptical, or oval shape. In other embodiments, the holder base 102 can be square, rectangular, triangular, or other polygonal shape. The holder base 102 may be fabricated from rubber-like materials such as silicone to enhance durability and restrict sliding across the flat surface 110 on the watercraft 108 because of increased friction. As illustrated in FIG. 3, in alternative embodiments, a tethering ring 302 attaches to the holder base 102. The tethering ring 302 can be used for tethering to one of the holder cords 204, or for carrying the vessel holder 100 when not in operation.

Turning now to FIG. 2, the vessel holder 100 provides a holder sidewall 104 that projects up from the base top face 300 of the holder base 102. The holder sidewall 104 may have a cylindrical shape. In other embodiments, the holder sidewall 104 has a square, rectangular, or irregular shape. In any case, the holder sidewall 104 is substantially continuous and designed to receive and hold upright a drinking vessel 106, such as a cup, glass, can, or bottle, for example and without limitation. As FIG. 3 shows, the holder sidewall 104 has a sidewall base end 200*b* and an opposing sidewall free end 200*a*. The sidewall base end 200*b* forms a *nexus* with the holder base 102, fixedly joining to the base top face 300 of the holder base 102.

Figure 4:
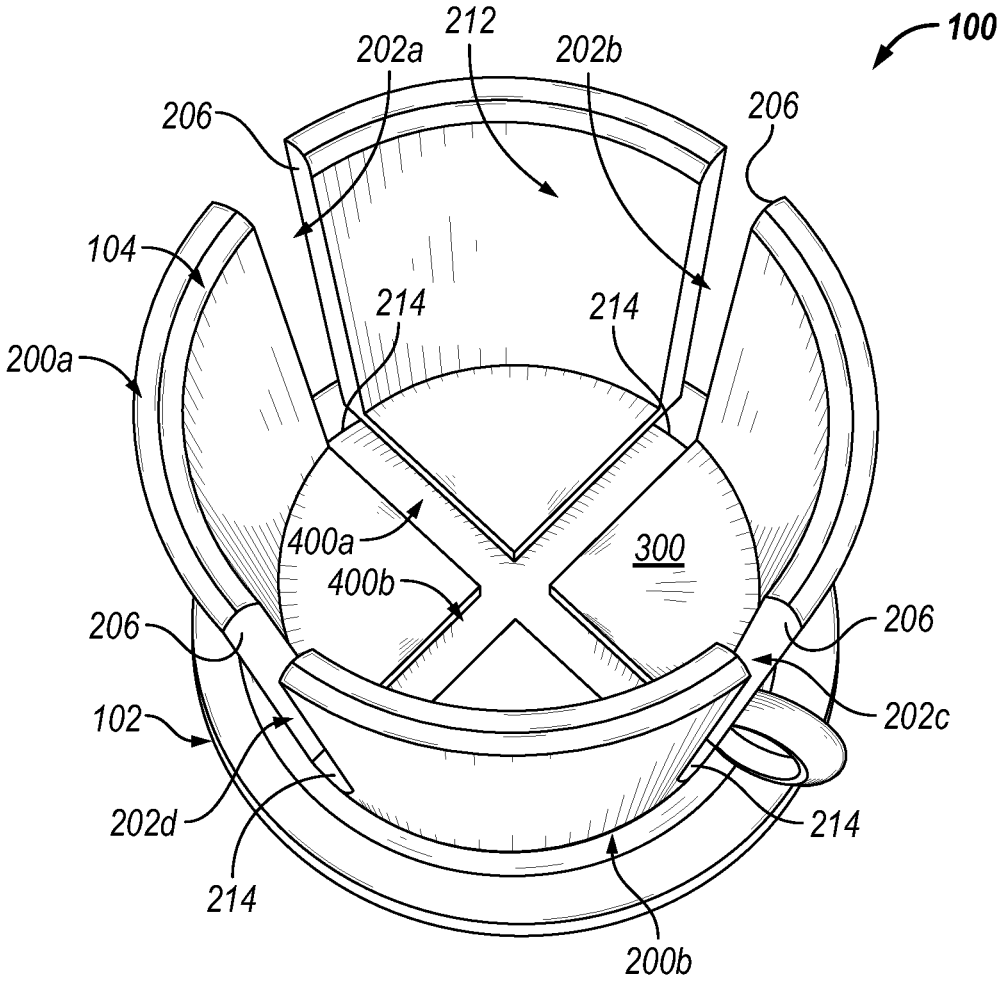
FIG. 4 illustrates a perspective view of the watercraft drinking vessel holder, showing the upper face of the base with linear depressions in the base aligned with the slots, in accordance with an embodiment of the present invention.
Figure 6:
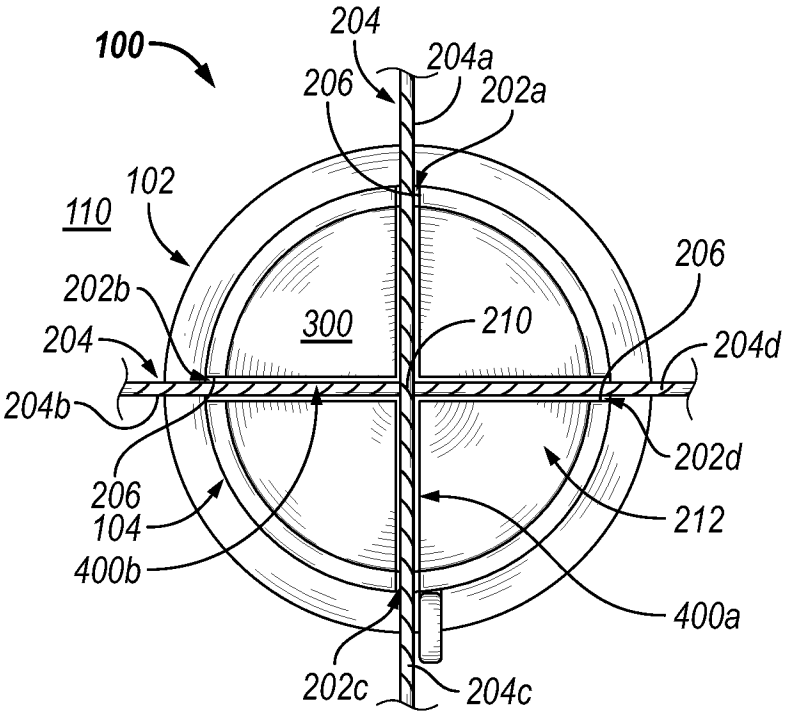
FIG. 6 is a top view of the watercraft drinking vessel holder with a pair of crisscrossing or intersecting cord strands of the holder cord securing the watercraft drinking vessel holder to a flat surface on the watercraft.
Figure 5:
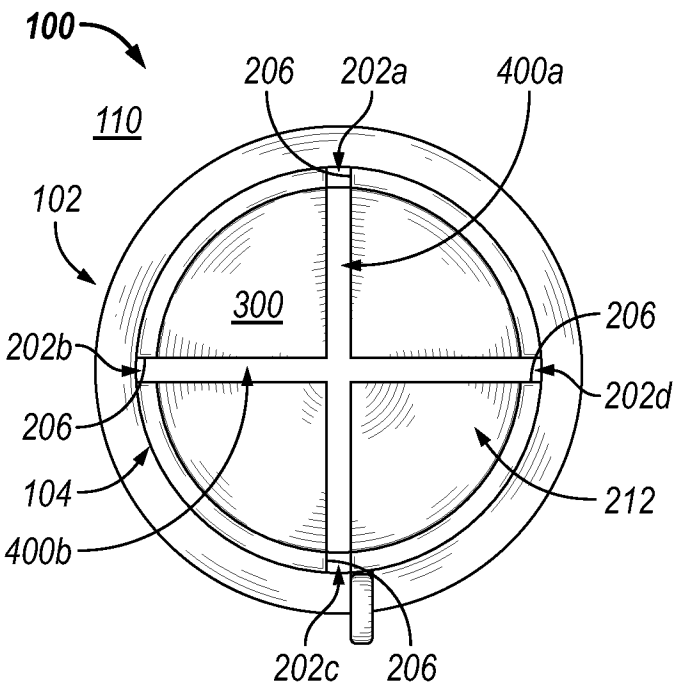
FIG. 5 is a top view of the watercraft drinking vessel holder.

As FIG. 4 illustrates, the holder sidewall 104 forms multiple spaced-apart, parallel sidewall slots 202*a-d* that extend from the sidewall free end 200*a*, to approximately the terminus of the sidewall base end 200*b*. FIG. 3 illustrates an upper perspective view of the watercraft drinking vessel holder 100, showing the sidewall slots 202*a-d* extending almost to the holder base 102. In alternative embodiments, the sidewall slots 202*a-d* may extend all the way down to the holder base 102. The depth of the sidewall slots 202*a-d* may enable the cord strands 204*a-d* of the holder cord or cords 204 (regardless of size on standard boards) to firmly rest below or flush with the base top face 300 on which the drinking vessel 106 typically sits in deployment of the drinking vessel 106 in the watercraft drinking vessel holder 100.

In some embodiments, the base top face 300 of the holder base 102 forms multiple linear depressions 400*a*, 400*b* which are aligned or register and communicate with the respective sidewall slots 202*a-d*. The linear depressions 400*a-b* enable the cord strands 204*a-d* of the holder cord or cords 204 to rest or seat snugly into the holder base 102 after being passed through the sidewall slots 202*a-d* and slid down to the holder base 102. FIG. 4 illustrates a perspective view of the watercraft drinking vessel 100, showing the base top face 300 of the holder base 102 with the linear depressions 400*a-b* aligned and communicating with the sidewall slots 202*a-d*.

The sidewall slots 202*a-d* also allow for flexibility on placement of the drinking vessel 106 on the watercraft 108 in case there is a cooler or other items (not illustrated) on or under the holder cord 204. Such a crossing slot arrangement allows the drinking vessel 106 to sit at the cord intersection 210 of the cord strands 204*a-d* of the holder cord 204 to provide more stability to the drinking vessel 106. In some embodiments, the sidewall slots 202*a-d* may be sized and dimensioned to receive at least one holder cord 204. The holder cord 204 may include a bungee cord, an elastic cable known in the art of watercraft or other element which is suitable for the purpose.

As illustrated in FIG. 4, the holder cord 204 crisscrosses or intersects through the sidewall slots 202*a-d* for securing the vessel holder 100 to the flat surface 110 of the watercraft 108. The ends of the holder cord 204 can be tethered to the sides of the watercraft 108 for anchoring thereto according to the knowledge of those skilled in the art. The holder cord 204 may be easily adjusted in this manner. The holder cord 204 can affix permanently to the watercraft 108 or be removed from their tether which allows for easy switching between multiple watercrafts 108. A single holder cord 204, or multiple holder cords 204 or cord strands 204*a-d* of one or more holder cords 204 that crisscross or intersect the sidewall slots 202*a-d* can be used. It is significant to note that the cord strands 204*a-d* can be used for retaining the vessel holder 100, even if other items such as coolers, shoes, etc. are on or under the holder cords 204 or cord strands 204*a-d*.

The present invention also teaches a method of attaching the vessel holder 100 to a watercraft 108 that has anchored thereto cords such as bungee cords. In a first Step of installation, the holder base 102 may be placed on a flat surface 110 at a desired location on the watercraft 108. The cord segments 204*a-d* of the holder cord or cords 204 may be pulled from the sides of the watercraft 108 and strategically inserted in the sidewall slots 202*a-d* at the respective open slot ends 206 thereof in a crisscrossed or intersecting orientation and then lowered through the respective sidewall slots 202*a-d* in the holder sidewalls 104 until the cord segments 204*a-d* insert and seat in the respective linear depressions 400*a-d* in the base top face 300 of the holder base 102. The drinking vessel 106 may then be placed in the holder interior 212, with the holder cord 204 allowing for a stable place for the drinking vessel 106 to sit while attaching the vessel holder 100 securely to the watercraft 108.

In this manner, the drinking vessel 106 may be deployed in the holder interior 212 in an upright manner, either before or after deployment of the holder cord 204 or cord segments 204*a-d*. Introducing the drinking vessel 106 into the holder interior 212 before deployment of the holder cord 204 or cord segments 204*a-d* may, however, be effective in preventing the drinking vessel 106 from resting on the holder cord 204 in an awkward disposition. Further, such a slotted attachment system is useful for holders/containers, other than cup shaped.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A watercraft drinking vessel holder, the vessel holder comprising:

a holder base having a base top face and a base bottom face, the base bottom face operable to rest flush against a flat surface of a watercraft;

a continuous, unitary holder sidewall projecting up from the base top face of the holder base, the holder sidewall defining a sidewall base end and a sidewall free end, the sidewall base end joined with the base top face of the holder base, the holder sidewall further defining a plurality of spaced-apart, parallel sidewall slots extending from the sidewall free end to approximately a terminus of the sidewall base end, the plurality of sidewall slots being sized and dimensioned to receive at least one holder cord; and a holder interior defined by the holder base and the holder sidewall, the holder interior sized and configured to receive the drinking vessel, wherein the holder cord extends through the plurality of sidewall slots and engages the holder base to secure the vessel holder to the watercraft.

2. The watercraft drinking vessel holder of claim 1, further comprising a tethering ring joined to the holder.

3. The watercraft drinking vessel holder of claim 1, wherein the base top face of the holder base forms at least one linear depression aligned with the plurality of sidewall slots.

4. The watercraft drinking vessel holder of claim 1, wherein the holder base has a circular shape.

5. The watercraft drinking vessel holder of claim 1, wherein the holder sidewall has a cylindrical shape.

6. The watercraft drinking vessel holder of claim 1, wherein the at least one holder cord comprises at least one elastic holder cord.

7. The watercraft drinking vessel holder of claim 1, wherein the holder base and the holder sidewall are fabricated from silicone.

8. The watercraft drinking vessel holder of claim 1, wherein each of the plurality of sidewall slots has an open slot end at the sidewall free end of the holder sidewall and a closed slot end at the sidewall base end.

9. A watercraft drinking vessel holder, the vessel holder comprising:

a holder base having a base top face and a base bottom face, the base bottom face operable to rest flush against a flat surface of a watercraft;

at least one linear depression recessed into the base top face of the holder base;

a continuous, unitary holder sidewall projecting up from the base top face of the holder base, the holder sidewall defining a sidewall base end and a sidewall free end, the sidewall base end joined with the base top face of the holder base, the holder sidewall further defining a plurality of spaced-apart, parallel sidewall slots extending from the sidewall free end to approximately a terminus of the sidewall base end, the plurality of sidewall slots being sized and dimensioned to receive at least one holder cord, the plurality of sidewall slots registering and communicating with the at least one linear depression in the base top face of the holder base; and a holder interior defined by the holder base and the holder sidewall, the holder interior sized and configured to receive the drinking vessel, wherein the holder cord extends through the plurality of sidewall slots and seats in the at least one linear depression to secure the vessel holder to the watercraft.

10. The watercraft drinking vessel holder of claim 9, further comprising a tethering ring joined to the holder.

11. The watercraft drinking vessel holder of claim 9, wherein the at least one linear depression comprises a pair of intersecting linear depressions.

12. The watercraft drinking vessel holder of claim 9, wherein the holder base has a circular shape.

13. The watercraft drinking vessel holder of claim 9, wherein the holder sidewall has a cylindrical shape.

14. The watercraft drinking vessel holder of claim 9, wherein the at least one holder cord comprises at least one elastic holder cord.

15. The watercraft drinking vessel holder of claim 9, wherein the holder base and the holder sidewall are fabricated from silicone.

16. The watercraft drinking vessel holder of claim 9, wherein each of the sidewall slots has an open slot end at the sidewall free end of the holder sidewall and a closed slot end at the sidewall base end.

17. A watercraft drinking vessel holder, the vessel holder comprising:

a circular holder base having a base top face and a base bottom face, the base bottom face operable to rest flush against a flat surface of a watercraft;

a plurality of intersecting linear depressions recessed into the base top face of the holder base;

at least one holder cord configured for attachment to the watercraft, the at least one holder cord having a plurality of cord strands;

a continuous, unitary, rubber or silicone holder sidewall projecting up from the base top face of the holder base, the holder sidewall defining a sidewall base end and a sidewall free end, the sidewall base end joined with the base top face of the holder base, the holder sidewall further defining a plurality of spaced-apart, parallel sidewall slots extending from the sidewall free end to approximately a terminus of the sidewall base end, the plurality of sidewall slots being sized and dimensioned to receive the plurality of cord strands, respectively, of the at least one holder cord, the plurality of sidewall slots registering and communicating with the plurality of intersecting linear depressions, respectively, in the base top face of the holder base;

a holder interior defined by the holder base and the holder sidewall, the holder interior sized and configured to receive the drinking vessel; and the plurality of cord strands of the at least one holder cord recessed in a crisscrossing or intersecting pattern in the plurality of intersecting linear depressions recessed in the base top face of the holder base.

18. The watercraft drinking vessel holder of claim 17, further comprising a tethering ring joined to the holder base.

19. The watercraft drinking vessel holder of claim 17, wherein the plurality of intersecting linear depressions comprises a pair of intersecting linear depressions.

20. The watercraft drinking vessel holder of claim 17, wherein the holder sidewall has a cylindrical shape.

* * * * *